US005207074A

United States Patent [19]

Cox et al.

[11] Patent Number: 5,207,074

[45] Date of Patent: May 4, 1993

[54] REFRIGERANT COIL APPARATUS AND ASSOCIATED CONDENSATE DRAIN PAN STRUCTURE

[75] Inventors: Jimmy L. Cox, Greenwood; John B. Greenfield; Kendall L. Ross, both of Fort Smith, all of Ark.

[73] Assignee: Rheem Manufacturing Company, New York, N.Y.

[21] Appl. No.: 863,438

[22] Filed: Apr. 3, 1992

Related U.S. Application Data

[63] Continuation-in-part of Ser. No. 638,825, Jan. 8, 1991, Pat. No. 5,121,613.

[51] Int. Cl.[5] ..... F25D 21/14

[52] U.S. Cl. ..... 62/285; 62/419; 62/515; 165/127; 165/150; 165/179

[58] Field of Search ..... 62/419, 515, 285; 165/127, 150, 179

[56] References Cited

U.S. PATENT DOCUMENTS

| | | | |
|---|---|---|---|
| 2,582,038 | 1/1952 | Jewell | 312/346 |
| 2,959,031 | 11/1960 | Hopkinson et al. | 62/288 |
| 3,000,193 | 9/1961 | Crider | 62/285 |
| 3,352,126 | 11/1967 | Beshekas | 62/286 |
| 3,596,475 | 8/1971 | Berger | 62/285 |
| 3,750,418 | 8/1973 | Maudlin | 62/285 |
| 3,827,483 | 8/1974 | Hopkinson | 165/145 |
| 3,882,690 | 5/1975 | Duell et al. | 62/288 |
| 4,000,779 | 1/1977 | Irwin | 62/285 |
| 4,034,804 | 7/1977 | Meijer | 165/148 |
| 4,546,820 | 10/1985 | Whipple | 62/285 |
| 4,679,405 | 7/1987 | Mitchell et al. | 62/285 |
| 4,687,604 | 8/1987 | Goettl | 261/29 |
| 4,783,971 | 11/1988 | Alba | 62/291 |
| 4,970,875 | 11/1990 | Kim | 62/285 |

*Primary Examiner*—Ronald C. Capossela
*Attorney, Agent, or Firm*—Konneker & Bush

[57] ABSTRACT

Using a series of identically sized, single row, single circuit refrigerant coil modules, fin/tube refrigerant coils of different nominal air conditioning tonnages are constructed by arranging different numbers of the identically sized module in accordion-pleated orientations, with each modular coil having the same depth in the direction of intended air flow across the coil. Compared to conventional "A" coils used on the indoor side of air conditioning circuits, these accordion-pleated modular coils are more compact in the air flow direction, provide more coil surface area, permit lower coil face velocities with higher fin density, and significantly reduce the overall coil manufacturing costs since only one size of coil slab needs to fabricated and inventoried to later assemble refrigerant coils of widely varying nominal air conditioning tonnages. A specially designed one piece molded condensate drain pan structure may be releasably snap-fitted onto the underside of the modular refrigerant coil, and is provided on opposite sides with support structures that are configured to slidably receive an opposed pair of interior rail members within the housing of an indoor air conditioning unit as the connected drain pan structure and modular coil are operatively inserted into the housing through an access opening therein. Accordingly, the drain pan may be secured to the modular coil, and the coil/drain pan assembly mounted within the air conditioning unit housing, without the conventional necessity of using sheet metal screws to effect these connections.

26 Claims, 6 Drawing Sheets

REFRIGERANT COIL APPARATUS AND ASSOCIATED CONDENSATE DRAIN PAN STRUCTURE

CROSS-REFERENCE TO RELATED APPLICATION

This application is a continuation-in-part of U.S. application Ser. No. 638,825 filed on Jan. 8, 1991 and entitled "COMPACT MODULAR REFRIGERANT COIL APPARATUS AND ASSOCIATED MANUFACTURING METHODS", now U.S. Pat. No. 5,121,613.

BACKGROUND OF THE INVENTION

The present invention relates generally to air conditioning and heat pump systems and more particularly, but not by way of limitation, relates to refrigerant coils and condensate drain pan structures operatively associated therewith.

The typical indoor coil utilized with heating and cooling indoor equipment is conventionally of an inverted "V" configuration defined by two multi-row, multi-circuit fin/tube refrigerant coil slabs across which air to be cooled is flowed on its way to the conditioned space served by a furnace or air handler. Indoor coils of this type (commonly referred to as "A-coils" in the air conditioning industry) are offered in various nominal tonnages, one air conditioning "ton" being equal to an air cooling capacity of 12,000 BTU/HR. Furnaces and other air handling equipment using this type of coil are normally offered to the residential or commercial customer in an appropriate range of air conditioning tonnages which are established by the size of the A-coil installed in the furnace, or other type of air handler, in conjunction with the correspondingly sized condenser side of the overall refrigeration circuitry.

A representative air conditioning tonnage range for residential furnace applications is, for example, one to five tons, while a representative light commercial tonnage range would be from five to twenty tons. Within this overall cooling capacity range, the tonnage increment between successively larger capacity A-coils is typically ½, 1, 2½ or 5 tons, with the tonnage increments usually being smaller at the lower end of the capacity spectrum.

Conventional refrigerant "A" coils have been the norm in this general furnace and air handler tonnage range for many years and have been, generally speaking, well suited for their intended purpose. However, they are also subject to a variety of well-known problems, limitations and disadvantages, particularly as pertains to their manufacture and incorporation in their associated furnaces, air handlers or the like.

For example, for each A-coil within a given multi-tonnage set thereof, it has heretofore been necessary to manufacture and inventory a differently sized pair of refrigerant coil slabs. As an example, if a manufacturer produces a line of heating and air conditioning equipment having a cooling range of from 1½ to 20 tons, there may representatively be twelve different capacity A-coils needed-e.g., A-coils of 1½, 2, 2½, 3, 3½, 4, 5, 7½, 10, 12½, 15 and 20 ton nominal air cooling capacities. Accordingly twelve differently sized refrigerant coil slabs must be manufactured and inventoried.

This conventional necessity increases both tooling costs and manufacturing floor space requirements, thereby also increasing the overall manufacturing costs associated with the air conditioning systems into which the A-coils are incorporated. Additionally, each of the A-coils in a necessary capacity range thereof will typically have different depths in the direction of intended air flow therethrough. For example, in up-flow furnaces, progressively larger capacity A-coils will have correspondingly increasing vertical installation height requirements. This ca result in the necessity of oversizing the cabinet height of an air handler to accommodate A-coils of varying heights. Moreover, in an attempt to reduce the number of differently dimensioned refrigerant coil slabs which must be manufactured and inventoried to assemble A-coils of the necessary different refrigeration capacities, many manufacturers provide relatively large capacity increments at the upper end of their capacity range. For example, in light commercial air conditioning equipment, the highest capacity unit may be 20 tons, while the next smaller unit may be 15 tons. If the system designer determines that, for the conditioned spaced to be served by the equipment, an air conditioning capacity of 16 tons is needed, he normally must select the 20 ton unit. This undesirably results in a 25% oversizing of the air conditioning system.

Another problem associated with a conventional coil of this general type is the drain pan structure typically secured to its underside to receive and drain away condensate dripping from the exterior of the coil during cooling operation thereof. The standard drain pan conventionally used in this application is formed from drawn sheet metal, with separate drain and overflow outlet fittings welded to the pan. In order to inhibit corrosion of the pan, it is normally formed from prepainted metal material or is painted after fabrication thereof. The welds must also be leak checked and painted as well.

Additionally, the pan must be screwed in place onto the underside of its associated coil, and the finished coil/drain pan structure must then be screwed in place within the housing of the air conditioning unit, furnace or heat pump in which the coil is to be used. Thus, the fabrication of the drain pan, its connection to the coil that it serves, and the installation of the coil/drain pan assembly have heretofore tended to be laborious and relatively expensive tasks.

In view or the foregoing, it can be seen that it would be desirable to provide improved refrigerant coil and related condensate drain pan apparatus that eliminates or at least substantially reduces the above-mentioned problems, limitations and disadvantages heretofore associated with conventional "A-coils" and their related condensate drain pan structures. It is accordingly an object of the present invention to provide such improved apparatus.

SUMMARY OF THE INVENTION

In carrying out principles of the present invention, in accordance with a preferred embodiment thereof, a series of identically sized flat refrigerant coil modules are utilized to form a plurality of air cooling or heating refrigerant coils of different nominal air conditioning tonnages, the coils having a different number of the modules arranged in an accordion pleated orientation.

Each of the identically sized modules is defined by a single row of parallel, laterally spaced apart heat exchange tubes serially interconnected to form a single refrigerant circuit having an inlet end for receiving refrigerant from a source thereof, and an outlet end for discharging the received refrigerant. A longitudinally spaced series of heat exchange fins are transversely connected to the heat exchange tubes.

The modular, accordion pleated fin/tube refrigerant coils of the present invention are particularly well suited as replacements for the two-slab "A-coils" conventionally incorporated in combination heating and air conditioning furnaces and the like and provide a variety of manufacturing and other advantages compared to such A-coils. For example, only one size flat refrigerant coil slab needs to be manufactured and inventoried since the accordion pleated refrigerant coil assemblies of the present invention are all fashioned from varying numbers of the identically sized coil modules. Additionally, the use of these identically sized coil modules permits the varying capacity coil assemblies which they define to have identical depths in the intended air flow direction across the coils. In turn, this permits the allocated dimensions of the coil housing or air handler, in the direction of air flow therethrough, to be essentially uniform for each furnace in a manufacturing series thereof.

Compared to conventional A-coils, the accordion pleated coils of the present invention, which are preferably defined by three or more coil modules, provide a substantially increased coil face area. For a given flow rate across the coils, during furnace or air handler operation, this increased face area reduces the coil face velocity of the air to a magnitude considerably below the minimum design velocity typically associated with A-coils. Specifically, the accordion pleated module coils of the present invention are preferably sized to provide operating face velocities in the range of from approximately 100 feet per minute to approximately 200 feet per minute.

While under conventional refrigerant coil design wisdom this unusually low coil face velocity is considered undesirable, it uniquely permits the accordion pleated modular coils of the present invention to be provided with very closely spaced heat exchange fins which are of an enhanced, slotted construction, to thereby substantially increase the air-to-fin heat exchange efficiency without increasing the air pressure drop across the accordion pleated coil to a level beyond that normally associated with conventional A-coils. Specifically, the modular coils of the present invention are designed to operate at an air side pressure drop of less than about 0.10".

To further improve the overall heat exchange efficiency of the accordion pleated coils, the primary heat exchange efficiency (i.e., the heat exchange occurring between the refrigerant and the coil tubes) is also increased by providing the tubes with an enhanced construction, preferably by forming internal grooves within the tubes.

In a preferred embodiment of the accordion pleated refrigerant coils, the identically sized refrigerant coil modules used to define the coils have a nominal air conditioning tonnage capacity of 0.5 tons (6,000 BTU/HR.). This, of course, provides the ability to set the coil-to-coil tonnage increments correspondingly at 6,000 BTU/HR. This very desirably reduced capacity increment, in turn, provides the system designer with the ability to very precisely match the indoor side of the overall air conditioning circuitry to the conditioned space building load requirements.

According to another aspect of the present invention, the accordion-pleated modular coil is provided with a uniquely configured one piece molded plastic drain pan structure that may also be utilized in conjunction with conventional "A" coils. Cooperating interengageable means are provided on the modular coil and the drain pan structure for releasably connecting the drain pan structure to the underside of the coil without the conventional necessity of using sheet metal screws to effect this connection. In a preferred embodiment thereof, the cooperating interengageable means include a pair of mounting plates secured to front and rear end portions of the coil and having connecting openings formed therein, and connection tab means formed on front and rear end portions of the drain pan structure. To releasably connect the drain pan structure to the underside of the coil, the connection tab means are simply snapped into the connection openings in the mounting plates.

Support means are formed on the drain pan structure for operatively supporting the connected drain pan structure and coil on opposite parallel rail members secured to opposite interior sides of the coil portion of an air conditioning unit housing. The support means are operative to slidably receive the rail members as the connected drain pan structure and coil are moved into the housing coil portion, through an appropriate access opening therein, and to slide outwardly along and then be released from the rail members as the connected drain pan structure and coil are subsequently moved outwardly through the access opening to remove them from the coil portion of the housing. This slide-in support technique permits the coil and its associated drain pan to be operatively mounted within an air conditioning unit housing without the conventional necessity of using sheet metal screws to effect such mounting.

Extending along a front end portion of the drain pan structure is a drain trough from the opposite ends of which a pair of hollow drain pipe connector fittings outwardly project. A pair of hollow overflow pipe connector fittings also project outwardly from the opposite ends of the drain trough above the drain pipe connector fittings. These four molded-in pipe connector fittings are preferably internally threaded, and have formed therein plastic knockout sections which may be removed to open the fittings. Accordingly, drain and overflow piping connections can conveniently be made to either side of the drain pan structure.

In a preferred embodiment thereof, the aforementioned support means include the drain pipe connector fittings, a pair of depending support brackets formed on opposite sides of the drain pan structure rearwardly adjacent the drain pipe connector fittings, and a pair of depending rear clip structures formed on the opposite sides of the drain structure adjacent a rear end portion thereof. As the connected drain pan structure and coil are rearwardly inserted through the access opening into the housing coil portion, the housing rail members are slidably received and retained within the rear clip structures. As the coil and drain pan structure continue to be moved into the housing coil portion, front end portions of the rail members are received between the support brackets and the drain pipe connector fittings. The inserted drain pan structure is thus slidably and removably supported, front and rear, along opposite side portions thereof within the air conditioning unit housing coil portion.

DETAILED DESCRIPTION

Figure 1:
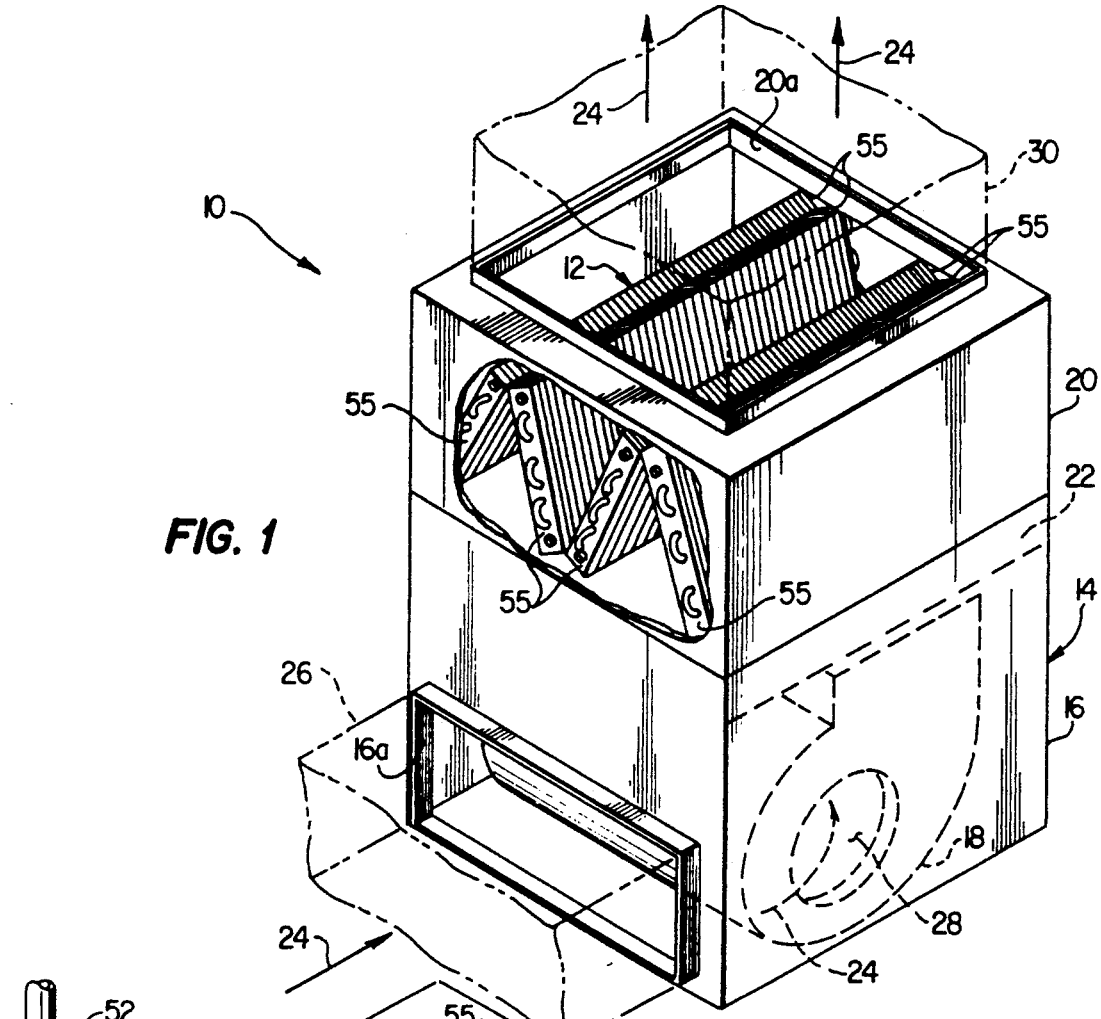
FIG. 1 is a partially cut-away schematic perspective view of a representative forced air furnace or air handler having installed thereon a compact, modular refrigerant coil which embodies principles of the present invention.

Perspectively illustrated in FIG. 1 is a typical indoor up-flow combination heating and cooling system 10 having incorporated therein a uniquely configured air-cooling evaporator coil 12 which embodies principles of the present invention. System 10 includes a housing 14 having a return air section 16 with a blower 18 disposed therein, and a coil housing section 20 disposed above the return air section 16. The coil 12, and a suitable air-heating structure 22 (such as an electric resistance heating coil or a fuel-fired heat exchanger) are operatively mounted within the housing section 20 and housing section 16, respectively.

During cooling operation of the system 10, return air 24 from the conditioned space served by the system is drawn into the housing return air section 16, by the blower 18, through a return duct 26 suitably connected to a housing opening 16*a*. Return air 24 entering the housing section 16 is drawn into the blower inlet 28 and forced by the blower 18 upwardly across the heating-/cooling coil 12. The cooled or heated air 24 is then flowed back to the conditioned space through a suitable supply duct 30 connected to top side opening 20*a* in the housing section 20.

Figure 2:
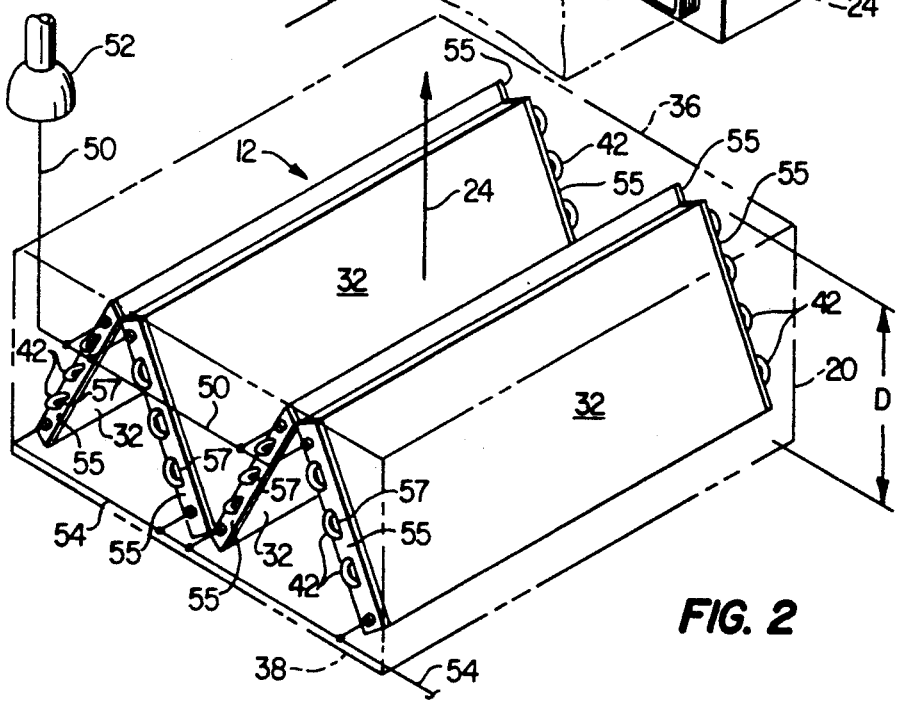
FIG. 2 is an enlarged scale perspective view of the modular coil removed from the furnace.
Figures 2A, 3A:
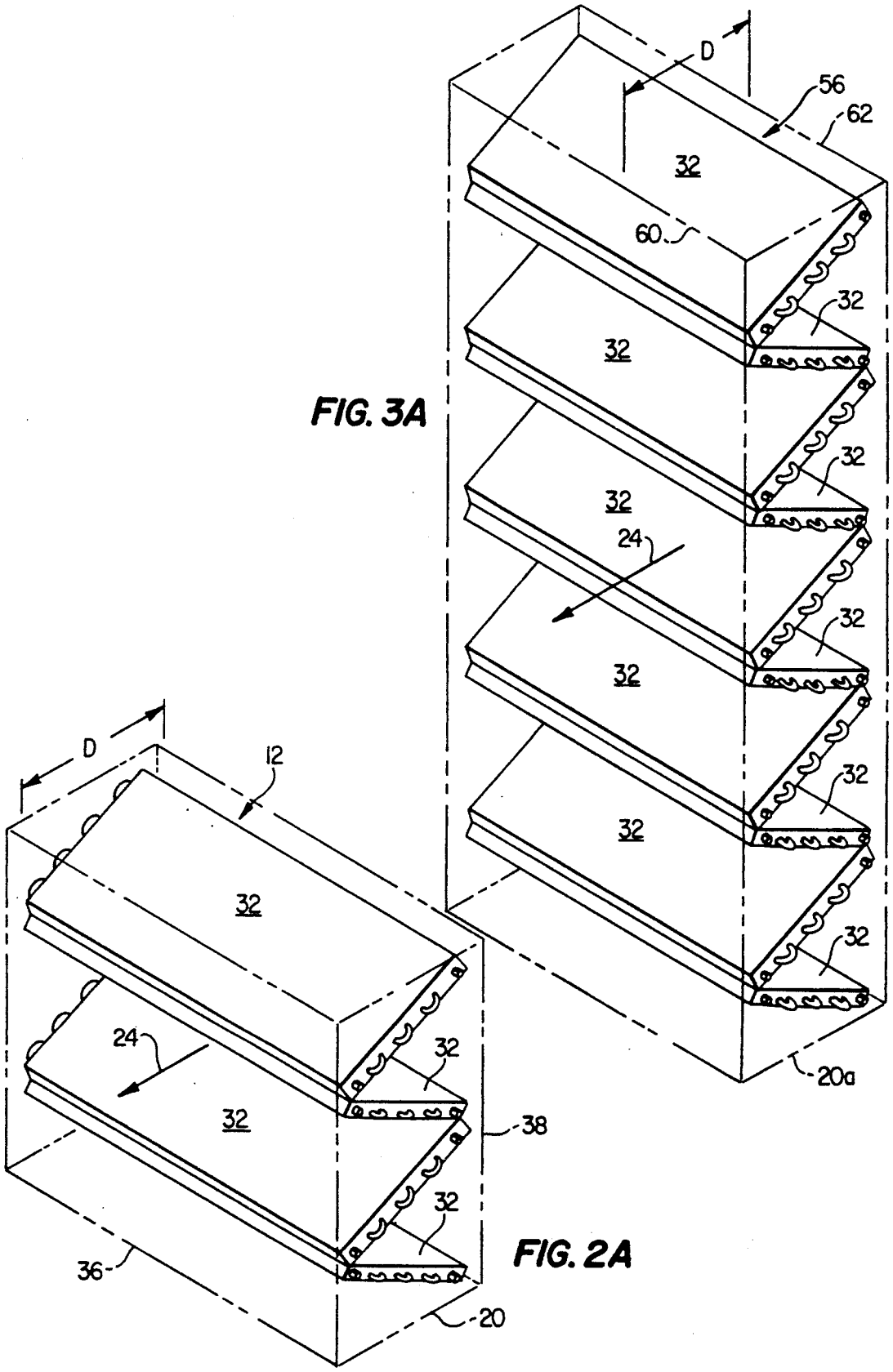
FIG. 2A is a perspective view of the FIG. 2 modular coil in an alternate, horizontal air flow orientation thereof.
FIG. 3A is a perspective view of the larger tonnage FIG. 3 modular coil in an alternate, horizontal air flow orientation thereof.
Figure 4:
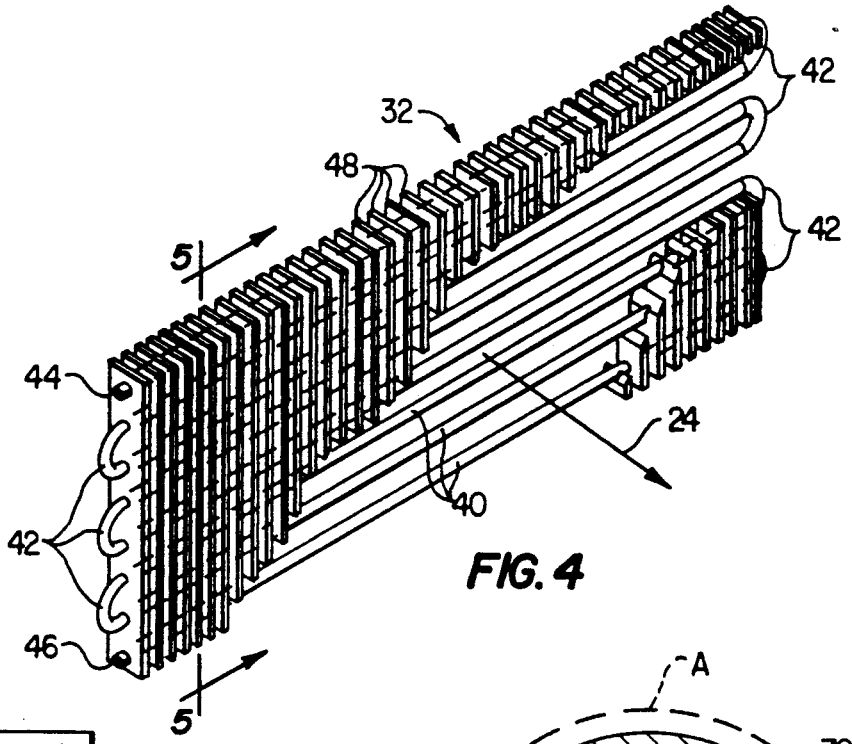
FIG. 4 is an enlarged scale, partially cut-away perspective view of one of the series of identically sized, single row, single circuit refrigerant coil modules used to form the representative refrigerant coils shown in FIGS. 2, 2A, 3 and 3A.

Turning now to FIGS. 2 and 4, according to an important feature of the present invention, the coil 12 (FIG. 2) is formed from four identically sized flat refrigerant coil modules 32 (FIG. 4) arranged in an accordion-pleated configuration and supported within the housing 20 which has an open top side 36 and an open bottom side 38. As illustrated, the coil 12 has a depth D extending parallel to the flow of air 24 externally across the coil. As depicted in FIG. 2A, the coil 12 may be repositioned, if desired, to provide for horizontal flow of the air 24 externally across the coil. In either the horizontal or vertical orientation of coil 12 the air flow across the coil may be opposite to that shown if desired.

Turning now to FIG. 4, the flat refrigerant coil module 32 utilized to form the modular coil 12 includes a single row of parallel, laterally spaced apart refrigerant heat exchange tubes 40 connected at their ends by conventional "U" fittings 42 to form a single refrigerant circuit having an open inlet end 44 and an open outlet end 46. Transversely connected to the heat exchange tubes 40 are a longitudinally spaced series of heat exchange fins 48. The coil 12 (FIG. 2) is operatively connected in the refrigeration circuit serving the system 10 by conventional refrigerant supply piping 50 connected to the tube inlets 44 of the coil modules 32 and provided with refrigerant expansion means 52, and refrigerant return piping 54 connected to the open tube outlets 46 of the four coil modules 32. If desired, the refrigerant flow through the coil modules 32 can be reversed simply by connecting the supply piping to the module outlets, and connecting the return piping to the module inlets.

With reference now to FIGS. 1 and 2, the coil 12 is supported within its associated housing 20 by means of two sets of interconnected support bars 55 secured to the opposite ends of the coil modules 32 and having slots 57 through which the U-fittings 42 outwardly pass. At their lower ends the bars 55 are connected to conventional drain pan means (not shown) that are fastened to housing 20. The coils depicted in FIGS. 2A, 3 and 3A are supported in a similar manner within their associated housings.

Figure 3:
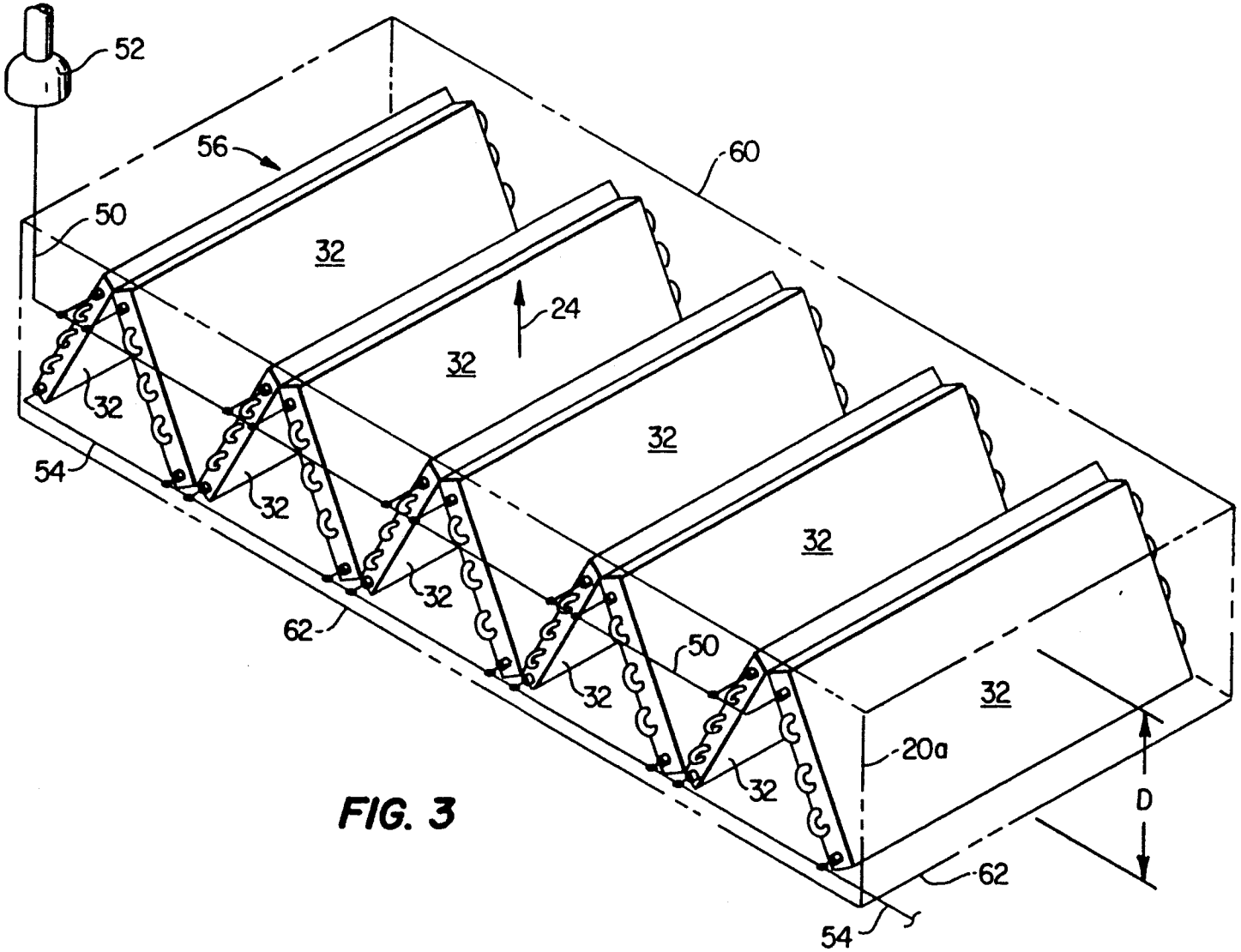
FIG. 3 is a perspective view of a representative larger tonnage version of the FIG. 2 modular coil.

According to a key aspect of the present invention, as may be seen by comparing FIGS. 2 and 3, a series of identical flat refrigerant coil modules 32 may be utilized to form a series of modular, accordion-pleated refrigerant coils, having identical coil depths D and different nominal air conditioning tonnages depending upon the number of modules 32 utilized to form the particular accordion pleated coil. For example, the larger coil 56 shown in FIG. 3 is formed from ten of the identically sized modules 32 arranged in an accordion pleated fashion and operatively supported in an appropriately larger housing 20*a* having an open top side 60 and an open bottom side 62. As may be seen by comparing FIGS. 3 and 3A, the larger coil 56, like the smaller coil 12, may be positioned in either vertical or horizontal air flow orientations.

The refrigerant coil module 32 illustrated in FIG. 4 representatively has a nominal air cooling capacity of 0.5 tons (6,000 BTU/HR.). Accordingly, the modular coil 12 has a nominal air cooling capacity of 2.0 tons, and the larger coil 56 has a nominal air cooling capacity of 5.0 tons. It will be appreciated, however, that the nominal air conditioning tonnage of each coil module 32 could be greater or smaller if desired. It will also be appreciated that the two illustrated coils 12 and 56 are merely representative of a wide variety of accordion pleated coils that could be formed utilizing different numbers of the identically sized coil modules 32, ranging from a two module coil to a coil having as many identically sized modules as is necessary to provide the required total air conditioning tonnage of the coil. For system applications, the minimum number of modules 32 utilized in a given coil is preferably three.

Compared to conventional "A"-coils utilized in systems such as the system 10 depicted in FIG. 1, the present invention's concept of utilizing selected numbers of identically sized coil modules to form accordion-pleated refrigerant coils of mutually different air conditioning capacities provides a variety of advantages. For example, as is well known, the production of A-coils of the different air conditioning capacities typically needed in a given equipment line necessarily entails the fabrication and inventorying of several differently sized refrigerant coil slabs used to form the A-coils. This, of course, requires increased production machinery and associated manufacturing floor space. Additionally, to accommodate the differently sized refrigerant coil slabs, it is necessary to produce a corresponding number of differently sized heat exchange fins. Moreover, the air conditioning capacity increments between successively larger A-coils, particularly at the upper end of the equipment's capacity spectrum, is typically considerably larger than 0.5 tons. This often results in the necessity of considerably oversizing the system's actual air conditioning capacity compared to the calculated air conditioning requirement for the conditioned space served by the system.

In the present invention, however, it is only necessary to fabricate and inventory refrigerant coil slabs of a single size to produce all of the different capacity coils needed in a typical equipment line. This advantageously reduces the overall coil manufacturing costs, thereby reducing the overall manufacturing costs of the system 10. Another advantage provided by the coil manufacturing method of the present invention is that the incremental air conditioning capacity increase between successively larger accordion pleated coils may be advantageously made uniform, and quite small, throughout the air conditioning capacity range of the particular equipment line. Using the illustrated coil module 32 as the "building block" for a series of different capacity air conditioning coils, this uniform increment would be 0.5 tons. The ability to economically provide this small air conditioning capacity increment permits the air conditioning capacity of the particular system to be very precisely matched to the actual air conditioning requirement of the conditioned space served by a particular system.

As previously mentioned, the coil depth D of each accordion-pleated coil fabricated from a selected number of the identically sized coil modules 32 may be easily made identical for each different capacity coil produced. This advantageously avoids the coil depth variation typically encountered when conventional A-coils are utilized. Accordingly, the coil housing length (in the air flow direction) necessary to accommodate each of the different capacity refrigerant coils of the present invention may be advantageously kept at a constant value regardless of which capacity air conditioning coil is installed on the furnace, air handler or heat pump.

The "face velocity" of an air conditioning coil is conventionally defined as the total volumetric air flow passing through the coil divided by the total effective upstream side surface area of the coil. Thus, the face velocity of a coil having a 2.0 square foot face area across which a 1200 cubic feet/minute air flow occurs would be 600 feet/minute. For many years it has been thought necessary to size refrigerant coils (such as conventional A-coils) used in the indoor sections of air conditioning equipment in a manner such that the coil face velocity is maintained within the 300–500 feet/minute velocity range.

Conventional coil design wisdom has been that a coil face velocity below about 300 feet/minute results in unacceptably low coil heat exchange efficiency, while a coil face velocity above about 500 feet/minute yields an unacceptable degree of condensate "blow through" and additionally raises the air pressure drop across the coil to an undesirable level.

Also in accordance with conventional coil design theory, the two refrigerant coil slabs used to define refrigerant A-coils are of a multi-row, multi-circuit construction for purposes of heat exchange efficiency. This multi-row/multi-circuit configuration, coupled with the coil face area needed to keep the face velocity of the coil within the traditional 300–500 feet/minute range, typically results in an air pressure drop across the coil that, as a practical matter, precludes the use in the coil of "enhanced" fins (i.e., fins of, for example, a lanced or louvered construction designed to increase the air-to-fin heat exchange efficiency). Typically, the increased pressure drop associated with this type fin enhancement is unacceptable in conventional refrigerant A-coils. Accordingly, conventional A-coils are usually provided with unenhanced fins.

The present invention significantly departs from this conventional refrigerant coil design theory in several regards. For example, as previously mentioned, each of the identically sized coil modules 32 is of a single row, single refrigerant circuit design. Additionally, the face area of each coil module 32 is preferably sized so that the face velocity of each multi-module coil, during operation of the air conditioning unit in which it is installed, is below the conventional 300 feet/minute lower limit. Preferably, such face velocity is in the range of from about 100 feet/minute to about 200 feet/minute. This face velocity reduction desirably and quite substantially reduces the air pressure drop across the coil, thereby reducing the power requirements for the furnace blower. Specifically, the modular coils of the present invention are preferably designed to operate with air pressure drops of less than about 0.10".

Figure 5:
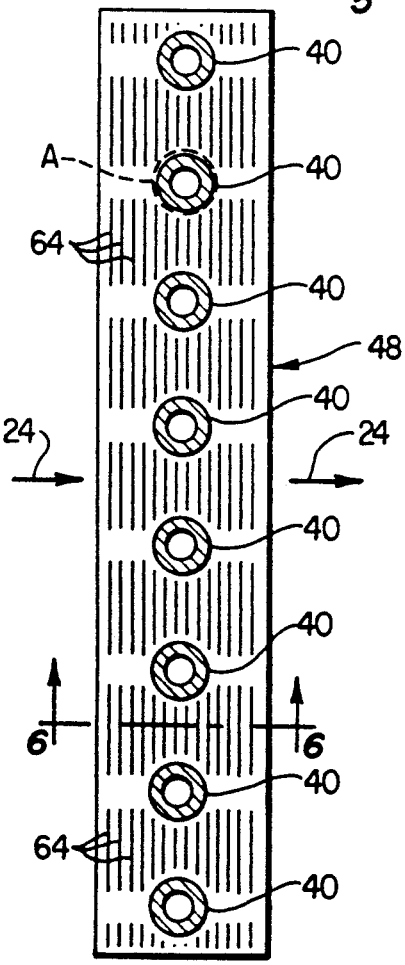
FIG. 5 is an enlarged scale cross-sectional view through the refrigerant coil module taken along line 5—5 of FIG. 4.
Figure 5A:
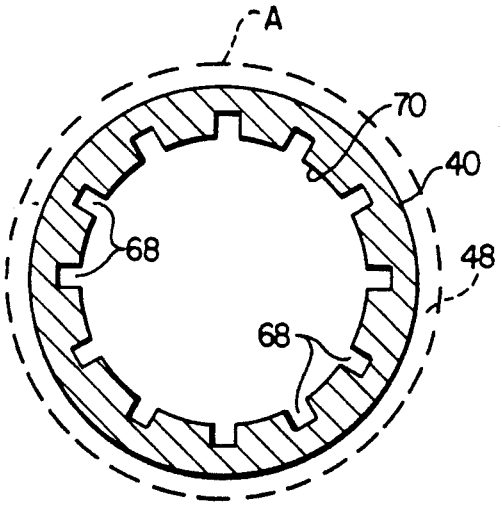
FIG. 5A is an enlargement of the circled area "A" in FIG. 5.
Figure 6:
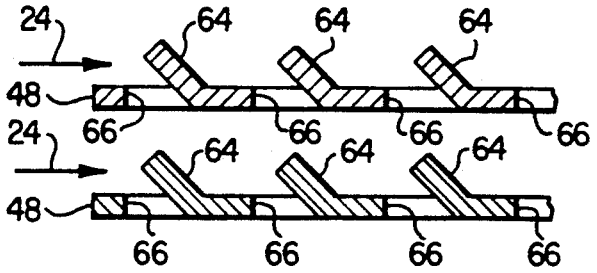
FIG. 6 is an enlarged scale partial cross-sectional view through an adjacent pair of enhanced heat exchange fins on the refrigerant coil module.

In turn, this substantial air pressure drop reduction permits a closer fin spacing to be used in the coil modules 32, the module fin spacing preferably being in the range of from about 16 fins/inch to about 22 fins/inch (compared to the 10–14 fins/inch used in conventional A-coils). The lowered face velocity of the accordion-pleated refrigerant coils of the present invention also permits the fins 48 to be of an enhanced construction as illustrated in FIGS. 5 and 6. While a variety of fin enhancement designs could be used, a representative louvered fin enhancement design is illustrated in FIGS. 5 and 6, and comprises louvers 64 formed in the fins and extending at an angle relative to the fin bodies and positioned adjacent fin openings 66 resulting from the formation of the louvers 64. This fin enhancement desirably increases the air-to-fin heat exchange efficiency of the coil modules 32. In the illustrated preferred embodiment of the coil module 32, its tubes 40 are internally enhanced, preferably by the formation of a circumferentially spaced series of radial grooves 68 (FIG. 5A) formed in the interior side surface 70 of each tube and extending along its length. This internal tube enhancement desirably increases the tube-to-refrigerant heat exchange efficiency of each coil module 32.

While the accordion-pleated refrigerant coils of the present invention have been illustrated in conjunction with the evaporator section of a forced air furnace 10, it will readily be appreciated by those skilled in this art that the coils of the present invention could also be used in other air conditioning applications such as in heat pumps or other types of air conditioning apparatus. Additionally, downflow or horizontal flow units could also have the coils of the present invention incorporated therein.

The single row/single circuit configuration of each of the coil modules 32 serves to maximize the primary heat transfer performance (i.e., the tube-to-refrigerant heat transfer efficiency) of the accordion-pleated refrigerant coil by maintaining a generally optimum refrigerant flow per circuit. When smooth coil tubes are utilized, this permits the optimization of refrigerant pressure drop. When internally grooved or otherwise internally enhanced coil tubes are used, this allows for the optimization of refrigerant pressure drop with shorter length tubes.

The single row/single circuit design of the coil modules also permits the secondary heat transfer performance (i.e., the air-to-fin heat exchange efficiency) of the coil to be maximized by allowing the maintenance of an optimum cfm/ton air flow ratio. In turn, this provides the previously mentioned low air face velocity for the coils of the present invention which yields reduced air side pressure drops, reduces water blow-off potential, and maintains the latent capacity for the coil. With plain (i.e., unenhanced) fins, this permits a considerably higher fin density than is achievable with conventional evaporator coils. With enhanced fins and unenhanced coil tubes, this permits a low fin density. On the other hand, when enhanced, internally grooved coil tubes are used, this permits a considerably higher enhanced fin density to match the shorter overall tubing length requirements.

Figure 7:
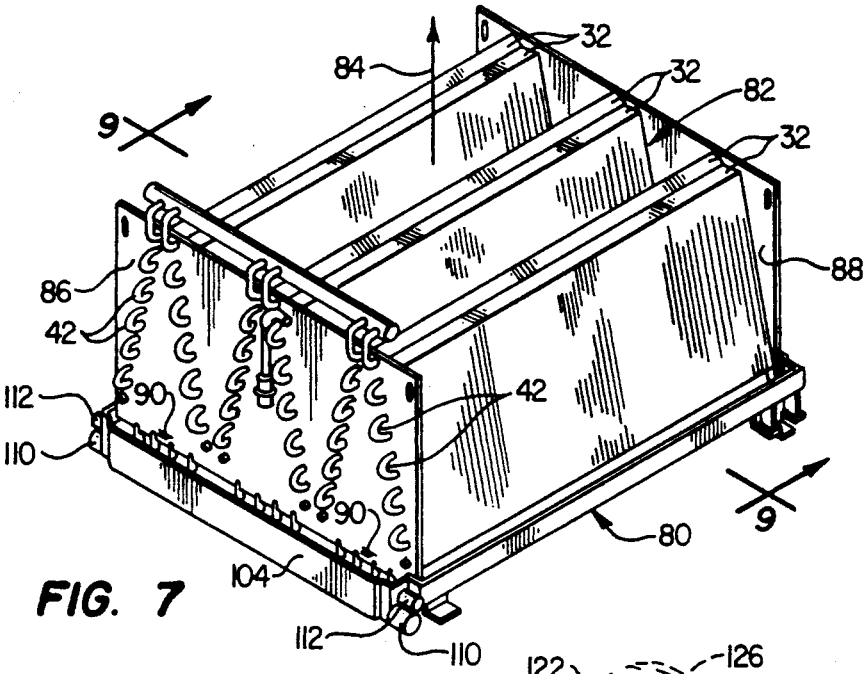
FIG. 7 is a perspective view of a representative modular refrigerant coil operatively connected to a specially designed one-piece molded plastic condensate drain pan also embodying principles of the present invention.
Figure 8:
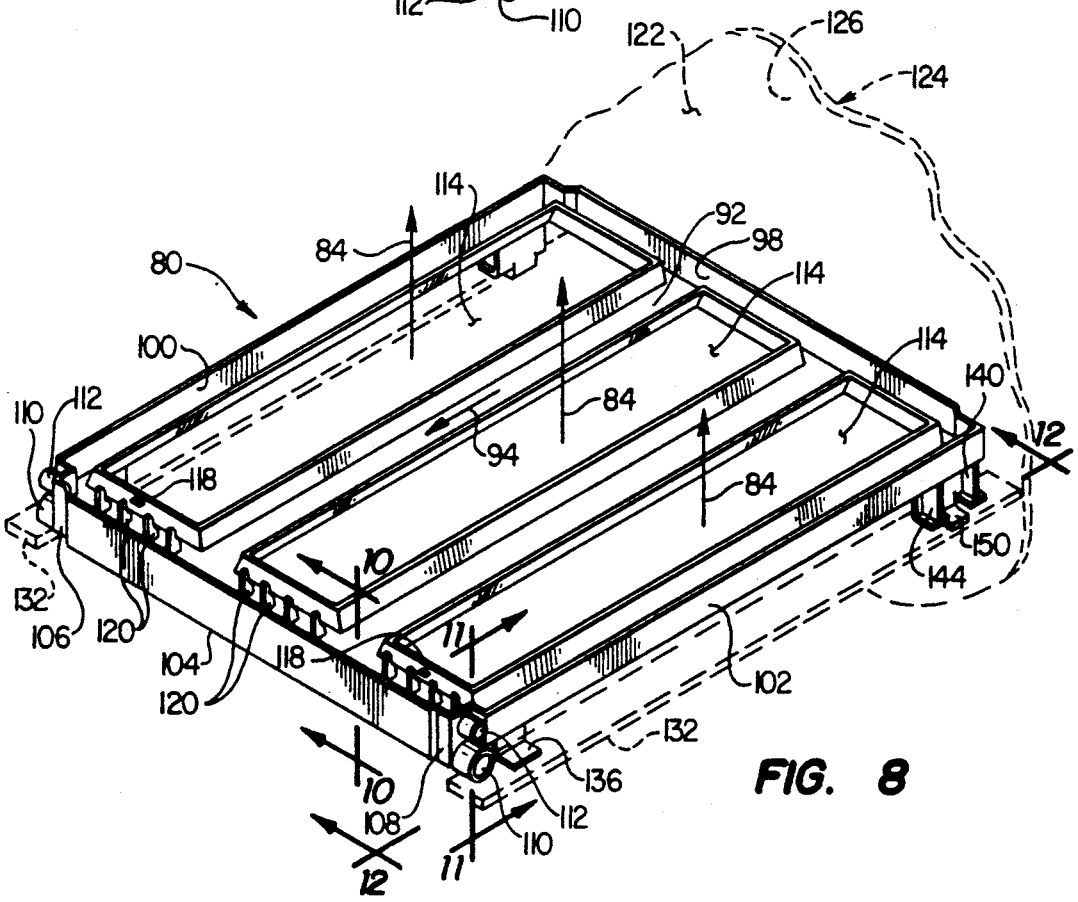
FIG. 8 is an enlarged scale perspective view of the condensate drain pan operatively connected to a phantomed pair of interior support rails within a furnace housing.
Figure 9:
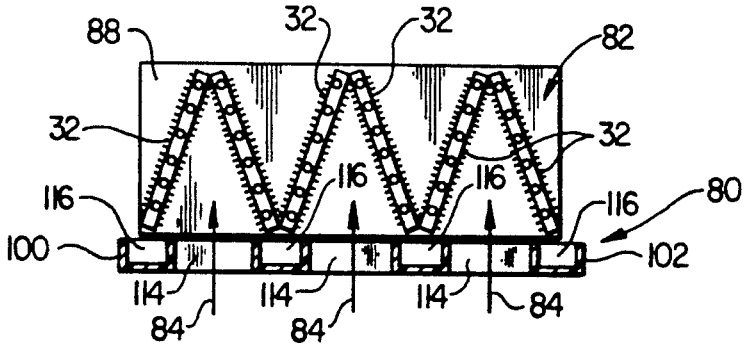
FIG. 9 is a schematic cross-sectional view taken through the coil/drain pan structure along line 9—9 of FIG. 7.

According to another aspect of the present invention, a specially designed one piece molded plastic condensate drain pan 80 is provided (see FIGS. 8 and 10–12), and is shown in FIGS. 7 and 9 operatively connected to the underside of a representative six module coil 82 similar in construction, and accordion-pleated configuration, to the previously described four and ten module coils 12 and 56. Coil 82 is representatively shown in an upflow configuration in which air 84 to be cooled is forced upwardly across the coil.

Parallel sheet metal mounting plates 86,88 (FIG. 7) are respectively secured to the front and rear ends of the coil 80. Plates 86,88 have rectangular configurations and, for purposes later described, have two small, spaced apart horizontal slots 90 formed along lower side edge portions thereof.

The drain pan 80 has a rectangular configuration sized to complementarily underlie the coil 82; a base wall 92 that slopes downwardly and forwardly as indicated by the arrow 94 in FIG. 8; upstanding front and rear end walls 96 and 98; and upstanding left and right side walls 100 and 102. As may be best seen in FIG. 10, front end wall 96 forms the front boundary of an elongated, open-topped drain trough 104 that longitudinally extends along the front end of the drain pan and has left and right end walls 106,108.

Projecting outwardly from each of the end walls 106,108 is a hollow, internally threaded drain pipe connector fitting 110 spaced downwardly apart from an outwardly projecting hollow, internally threaded overflow pipe connector fitting 112 of a smaller diameter. In the molding of the drain pan 80, thin plastic knockout sections **110*a*,112*a* (FIG. 11) are formed in the fittings 11, and may simply be broken out to open their associated fittings. The provision of drain and overflow pipe connector fittings on opposite sides of the drain pan conveniently permits drain and overflow pipes 110*b* and 112*b* to be connected to associated fittings 110,112 (as shown in phantom in FIG. 11) on either side of the drain pan 80**.

Referring now to FIGS. 8 and 9, three upwardly rimmed openings 114 are formed through the bottom base wall 92 to permit the upward flow of air 84 through the drain pan 80 and then externally across the coil 82. These rimmed openings 114 are interdigitated with four forwardly and downwardly sloped drain troughs 116 through which condensate dripping from coil 80 flows into the front end trough 104. With the drain pan 80 connected to the underside of coil 82 in a manner subsequently described, troughs 116 underlie and extend parallel to the bottom side edges of the individual coil slabs 32 as schematically indicated in FIG. 9.

Figure 10:
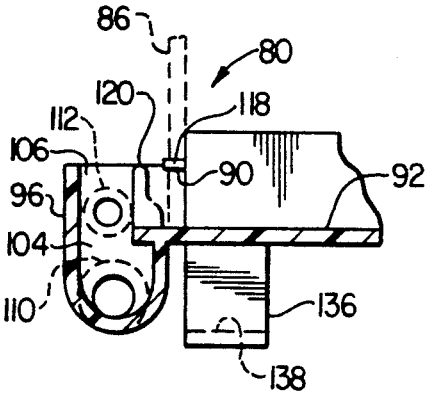
FIG. 10 is an enlarged scale cross-sectional detail view through the condensate drain pan taken along line 10—10 of FIG. 8.
Figure 11:
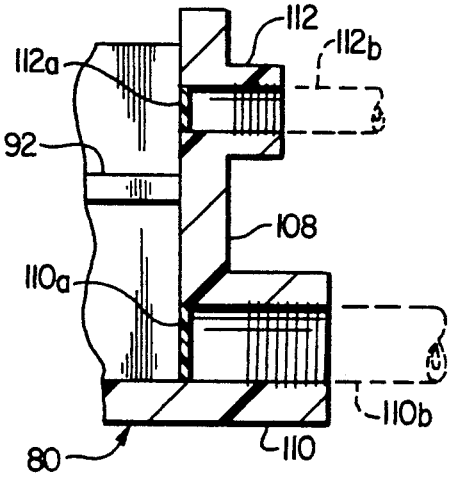
FIG. 11 is an enlarged scale cross-sectional detail view through the condensate drain pan taken along line 11—11 of FIG. 8.

With reference now to FIGS. 8 and 10, two of the front and rear end rim portions of the drain pan air flow openings 114 have formed thereon an outwardly projecting connection tab 118. To removably connect the drain pan 80 to the underside of the coil 82, the lower side edges of the mounting plates 86,88 are simply slipped downwardly and outwardly over the tabs 118 until the tabs snap outwardly through the mounting plate slots 90 as shown in FIG. 10. To facilitate this removable snap-in connection, which avoids the conventional necessity of using sheet metal screws, spaced series of upwardly projecting retention tabs 120 are formed on front and rear end portions of the bottom drain pan wall 92 outwardly of the tabs 118. Tabs 120 serve to guide the lower mounting plate edge portions into place, and also function to restrain them in place after the tabs 118 have snapped into the mounting plate slots 90.

Figure 12:
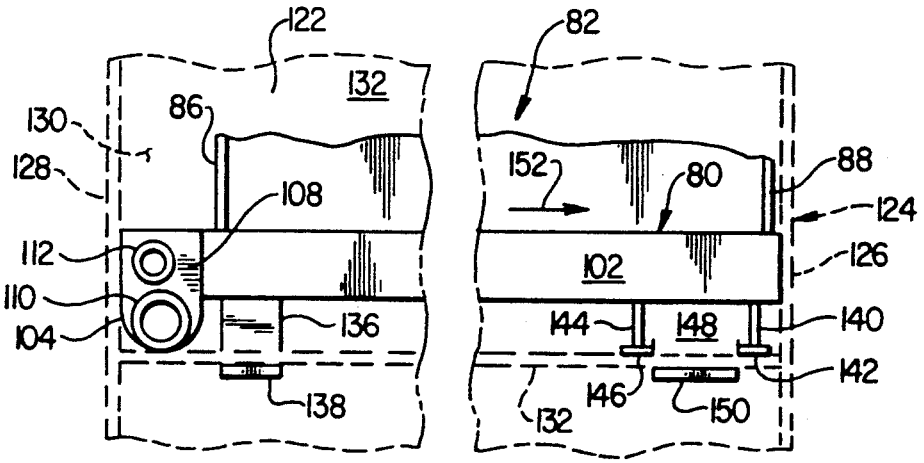
FIG. 12 is an enlarged fragmentary scale right side elevational view of the condensate drain pan taken along line 12—12 of FIG. 8 and illustrating the slide-in connection of the pan, and its associated refrigerant coil, to the furnace housing.

Referring now to FIGS. 8, 10 and 12, the connected drain pan 80 and coil 82 may be easily and quickly installed within the coil portion 122 of an air conditioning unit housing 124 (see FIG. 12), without the customary use of sheet metal screws, in a manner which will now be described. The housing coil portion 124 has a rear wall 126; a front access door 128 openable to expose an access opening 130 leading into the interior of the housing coil portion 122; a pair of opposite side walls 132; and a pair of internal, horizontally extending support rails 134 affixed to the side walls 132 adjacent opposite sides of the access opening 130.

Formed on the opposite sides of the drain pan, adjacent the opposite end walls 106,108 of the trough 104, are a pair of depending brackets 136 having outwardly projecting bottom end lips 138 which are rearwardly and slightly downwardly offset relative to the bottom side surfaces of the drain pipe connector fittings 110. Depending from each of the rear corners of the drain pan 80 is a connection clip structure including a first clip member 140 having an outwardly projecting bottom end lip 142; a second clip member 144 spaced forwardly apart from the clip member 140 and having an outwardly projecting bottom end lip 146 vertically aligned with the lip 142; and a third clip member 148 positioned between clip members 140 and 144 and having an outwardly projecting bottom end lip 150 positioned at a slightly lower level than lips 142 and 146, and vertically aligned with lip 138.

Referring now to FIG. 12, to rapidly and removably install the connected drain pan 80 and coil 82 within the air conditioning unit housing portion 122 (for example, above a supply fan in the housing), the access door 128 is opened and a rear end portion of the coil/drain pan assembly is inserted into the housing portion 122 in a manner causing front end portions of the rails 132 to be slidably received in the gaps between the lips 150 and their associated lips 142,146 at the rear corners of the drain pan. The coil/drain pan assembly is then pushed rearwardly into the housing portion 122, as indicated by the arrow 152, thereby causing each of the lip sets 142,146,150 to slide rearwardly along its associated rail 132.

As the rear end of the coil/drain pan assembly approaches the rear housing wall 126, the front ends of the rails 132 pass over the front bracket lips 138 and then under the drain pipe connector fittings 110 as the assembly reaches its fully inserted position shown in FIG. 12. The access door 128 is then closed to captively retain the coil/drain pan assembly within the housing coil portion 122. As can be seen in FIG. 12, the fittings 110, the brackets 136, and the clips 140,144,148 collectively define, at the front and rear ends of the drain pan, support means for slidably and removably supporting the coil/drain pan assembly within the air conditioning unit housing.

The assembly can be subsequently removed from the housing simply by opening the access door 128 and sliding the assembly rearwardly off the rails 132 and outwardly through the access opening 130. While the drain pan structure 80 of the present invention has been illustratively described as being used in conjunction with a uniquely configured modular coil of the present invention, it will be readily appreciated that it could also be used to advantage with conventionally configured "A" coils if desired.

.The foregoing detailed description is to be clearly understood as being given by way of illustration and example only, the spirit and scope of the present invention being limited solely by the appended claims.

What is claimed is:

1. An indoor air conditioning unit for receiving air from a conditioned indoor space, altering the temperature of the received air, and then discharging the air for return to the conditioned indoor space, said air conditioning unit comprising:

housing means having an inlet opening and an outlet opening, said housing means being operative to receive a throughflow of air from said inlet opening to said outlet opening;

blower means for flowing air through said housing from said inlet opening to said outlet opening;

a modular refrigerant coil assembly positioned in said housing means in the path of air flow therethrough between said inlet opening and said outlet opening, said modular refrigerant coil assembly comprising at least three substantially identically sized flat coil modules positioned in an accordion-pleated array having an inlet side collectively defined by side surfaces of said at least three refrigerant coil modules, each of said at least three coil modules being defined by:

a single row of parallel, laterally spaced apart refrigerant heat exchange tubes serially interconnected to form a single refrigerant circuit in the coil module, said single refrigerant circuit having an inlet end for receiving refrigerant from a source thereof and an outlet end for discharging the received refrigerant, and a longitudinally spaced series of heat exchange fins transversely connected to said heat exchange tubes, the fin spacing on the coil module being within the range of from about 16 fins/inch to about 22 fins/inch, said blower means and said refrigerant coil being relatively sized in a manner such that, during operation of said blower means, the face velocity of air flowing across said refrigerant coil is within the approximate range of from about 100 feet/minute to about 200 feet/minute, and the total air pressure drop across said refrigerant coil assembly is approximately 0.1" of less;

a drain pan structure positioned beneath said modular refrigerant coil to receive condensate dripping therefrom during cooling operation thereof;

first cooperating means formed on said modular refrigerant coil assembly and said drain pan structure for releasably securing said drain pan structure to the underside of said modular refrigerant coil assembly; and second cooperating means formed on said drain pan structure and said housing means for releasably securing said drain pan structure to said housing means.

2. The indoor air conditioning unit of claim 1 wherein said first cooperating means are operative to create a releasable snap fit connection between said modular refrigerant coil assembly and said drain pan structure.

3. The indoor air conditioning unit of claim 2 wherein said first cooperating means include:

first and second parallel plate members secured to oppositely facing end edge portions of the coil modules, each of said first and second plate members having a spaced series of slots formed therethrough, and spaced apart first and second series of tab members formed on said drain pan structure and configured to be releasably snapped into said slots.

4. The indoor air conditioning unit of claim 1 wherein:

said housing means have an access opening through which the releasably connected drain pan structure and modular refrigerant coil assembly may be inserted into said housing means, and said second cooperating means are operative to releasably secure said drain pan structure to said housing means in response to the insertion of the releasably connected drain pa structure and modular refrigerant coil assembly into said housing means through said access opening.

5. The indoor air conditioning unit of claim 4 wherein said second cooperating means include:

an opposed pair of elongated, parallel rail members interiorly secured to said housing means, and support means, positioned on opposite sides of said drain pan structure, for slidably receiving said rail members as the connected drain pan structure and modular refrigerant coil assembly are inserted into said housing means through said access opening.

6. The indoor air conditioning unit of claim 1 wherein said drain pan structure is of a one piece molded plastic construction.

7. The indoor air conditioning unit of claim 1 further comprising:

refrigerant supply piping means connected to each of said single circuit inlet ends and operative to flow a refrigerant from a source thereof through said at least three refrigerant coil modules, and refrigerant return piping means connected to each of said single circuit outlet ends and operative to receive refrigerant discharged therefrom.

8. The indoor air conditioning unit of claim 1 wherein each of said at least three coil modules has a nominal air conditioning tonnage capacity of approximately 0.5 tons.

9. The indoor air conditioning unit of claim 1 wherein said air conditioning unit is a forced air furnace.

10. The indoor air conditioning unit of claim 1 wherein said air conditioning unit is a heat pump.

11. An indoor unit portion of an air conditioning system, said indoor unit portion being operative to receive air from a conditioned indoor space, alter the temperature of the received air, and then discharge the air for return thereof to the conditioned indoor space, said indoor unit portion comprising:

housing means having an air inlet opening for receiving air returned from the conditioned indoor space, an air outlet opening for discharging air for return to the conditioned indoor space, and an interior flow passage extending between said inlet opening and said outlet opening;

a modular refrigerant coil assembly operatively disposed within said flow passage between said inlet opening and said outlet opening, said modular refrigerant coil assembly comprising at least three substantially identically sized flat coil modules positioned in an accordion-pleated array having an inlet side collectively defined by side surfaces of said at least three refrigerant coil modules facing in said first direction, each of said at least three coil modules being defined by:

a single row of parallel, laterally spaced apart refrigerant heat exchange tubes serially interconnected to form a single refrigerant circuit in the coil module, said single refrigerant circuit having an inlet end for receiving refrigerant from a source thereof and an outlet end for discharging the received refrigerant, and a longitudinally spaced series of heat exchange fins transversely connected to said heat exchange tubes;

blower means, positioned in said flow passage, for flowing air externally across said modular refrigerant coil assembly in said first direction, said blower means and said refrigerant coil being relatively sized in a manner such that, during operation of said blower means, the coil face velocity of air flowing externally across said refrigerant coil assembly in said first direction is within the approximate range of from about 100 feet/minute to about 200 feet/minute, and the total air pressure drop across said modular refrigerant coil assembly is approximately 0.1" or less;

a drain pan structure positioned beneath said modular refrigerant coil to receive condensate dripping therefrom during cooling operation thereof;

first cooperating means formed on said modular refrigerant coil assembly and said drain pan structure for releasably securing said drain pan structure to the underside of said modular refrigerant coil assembly; and second cooperating means formed on said drain pan structure and said housing means for releasably securing said drain pan structure to said housing means.

12. The indoor unit portion of claim 11 wherein said first cooperating means are operative to create a releasable snap fit connection between said modular refrigerant coil assembly and said drain pan structure.

13. The indoor unit portion of claim 12 wherein said first cooperating means include:

first and second parallel plate members secured to oppositely facing end edge portions of the coil modules, each of said first and second plate members having a spaced series of slots formed therethrough, and spaced apart first and second series of tab members formed on said drain pan structure and configured to be releasably snapped into said slots.

14. The indoor unit portion of claim 11 wherein:

said housing means have an access opening through which the releasably connected drain pan structure and modular refrigerant coil assembly may be inserted into said housing means, and said second cooperating means are operative to releasably secure said drain pan structure to said housing means in response to the insertion of the releasably connected drain pan structure and modular refrigerant coil assembly into said housing means through said access opening.

15. The indoor unit portion of claim 14 wherein said second cooperating means include:

an opposed pair of elongated, parallel rail members interiorly secured to said housing means, and support means, positioned on opposite sides of said drain pan structure, for slidably receiving said rail members as the connected drain pan structure and modular refrigerant coil assembly are inserted into said housing means through said access opening.

16. The indoor unit portion of claim 11 wherein said drain pan structure is of a one piece molded plastic construction.

17. The indoor unit portion of claim 11 wherein the fin spacing on each of said at least three refrigerant coil modules is within the range of from about 16 fins/inch to about 22 fins/inch.

18. The indoor unit portion of claim 11 wherein said indoor unit portion is a forced air furnace.

19. The indoor unit portion of claim 11 wherein said indoor unit portion is a heat pump.

20. An air conditioning unit comprising:

a housing having an air inlet opening and an air outlet opening, a coil portion positioned between said air inlet opening and said air outlet opening, an access opening leading into said coil portion of said housing, and a pair of opposed parallel rail members positioned within said coil portion of said housing adjacent opposite sides of said access opening;

a refrigerant coil positioned within said coil portion of said housing and including at least two refrigerant coil slabs oriented in an accordion-pleated array;

a one piece molded plastic condensate drain pan structure positioned beneath said refrigerant coil;

cooperating interengageable means on said drain pan structure and said refrigerant coil for releasably connecting said drain pan structure to the underside of said refrigerant coil; and support means carried by said drain pan structure for supporting the connected drain pan structure and refrigerant coil on said rail members, said support means being operable to slidably receive and move inwardly along said rail members as the connected drain pan structure and refrigerant coil are moved into said coil portion of said housing through said access opening, and to slide outwardly along and then be released from said rail members as the connected drain pan structure and refrigerant coil are subsequently moved outwardly through said access opening to remove the connected drain pan structure and refrigerant coil from said coil portion of said housing.

21. The air conditioning unit of claim 20 wherein:

said refrigerant coil has front and rear end portions defined by opposite end surfaces of said at least two refrigerant coil slabs, said drain pan structure has front and rear end portions, and said cooperating interengageable means include:

a spaced pair of parallel mounting plates secured to said front and rear end portions of said refrigerant coil and having connection openings formed therethrough, and connection tabs formed on said front and rear portions of said drain pan structure, said connection tabs being removably insertable into said connection openings to removably connect said drain pan structure and said refrigerant coil.

22. The air conditioning unit of claim 20 wherein:

said drain pan structure has front and rear end portions, and opposite side portions extending between said front and rear end portions, and said support means include first and second clip means formed on said opposite side portions of said drain pan structure, adjacent said rear end portion thereof, and operative to slidably receive said rail members.

23. The air conditioning unit of claim 20 wherein:

said drain pan structure has front and rear end portions, opposite side portions extending between said front and rear end portions, a drain trough extending along said front end portion and having opposite ends adjacent said opposite side portions of said drain pan, and a pair of hollow drain pipe connector fittings formed on and projecting outwardly from said opposite ends of said drain trough, and a pair of depending support brackets formed on said opposite side portions of said drain pan structure adjacent said drain pipe connector fittings, and said support means include said drain pipe connector fittings and said pair of depending support brackets, each drain pipe connector and its adjacent support bracket being relatively positioned to receive therebetween one of said rail members as the connected drain pan structure are operatively moved into said coil portion of said housing through said access opening.

24. The air conditioning unit of claim 20 wherein said drain pan structure has a drain trough extending along a front end portion thereof and having opposite ends, a pair of hollow drain pipe connector fittings projecting outwardly from said opposite ends, and a pair of hollow overflow pipe connector fittings projecting outwardly from said opposite ends above said drain pipe connector fittings, whereby condensate drain and overflow piping connections can be made to either side of said drain pan structure.

25. The air conditioning unit of claim 24 wherein each of said drain pipe and overflow pipe connector fittings has integrally formed therein a plastic knockout portion.

26. The air conditioning unit of claim 25 wherein each of said drain pipe and overflow pipe connector fittings has molded-in internal pipe threads.

* * * * *

UNITED STATES PATENT AND TRADEMARK OFFICE

CERTIFICATE OF CORRECTION

PATENT NO. : 5,207,074
DATED : May 4, 1993
INVENTOR(S) : Jimmy L. Cox, et al.

It is certified that error appears in the above-indentified patent and that said Letters Patent is hereby corrected as shown below:

Column 2, line 8, delete "ca" and insert --can--.

Column 12, line 64, delete "pa" and insert --pan--.

Signed and Sealed this
Third Day of May, 1994

Bruce Lehman

*Attest:*

BRUCE LEHMAN

*Attesting Officer*

*Commissioner of Patents and Trademarks*